United States Patent [19]

Bernasek et al.

[11] Patent Number: 4,887,618

[45] Date of Patent: Dec. 19, 1989

[54] TOBACCO PROCESSING

[75] Inventors: Edward Bernasek, Winston-Salem; Kenneth A. Bridle, Walnut Cove; William L. Clapp; Barry S. Fagg, both of Winston-Salem, all of N.C.

[73] Assignee: R. J. Reynolds Tobacco Company, Winston-Salem, N.C.

[21] Appl. No.: 195,985

[22] Filed: May 19, 1988

[51] Int. Cl.[4] ..... A24B 15/00

[52] U.S. Cl. ..... 131/297; 131/298

[58] Field of Search ..... 131/297, 298

[56] References Cited

U.S. PATENT DOCUMENTS

| | | | |
|---|---|---|---|
| 3,132,651 | 5/1964 | Kiefer . | |
| 3,240,214 | 3/1966 | Bavley et al. | 131/141 |
| 3,513,857 | 5/1970 | Silberman | 131/140 |
| 3,636,097 | 1/1972 | Harvey | 260/527 R |
| 3,747,608 | 7/1973 | Gravely et al. | 131/141 |
| 4,135,521 | 1/1979 | Malan et al. . | |
| 4,289,147 | 9/1981 | Wildman et al. . | |
| 4,307,733 | 12/1981 | Teng et al. | 131/293 |
| 4,308,877 | 1/1982 | Mattina . | |
| 4,347,324 | 8/1982 | Wildman et al. . | |
| 4,407,307 | 10/1983 | Gaisch et al. . | |
| 4,476,881 | 10/1984 | Gravely et al. | 131/308 |
| 4,537,204 | 8/1985 | Gaisch et al. . | |
| 4,572,219 | 2/1986 | Gaisch et al. | 131/308 |
| 4,700,727 | 10/1987 | Torigian | 131/369 |
| 4,709,710 | 12/1987 | Gaisch et al. | 131/308 |
| 4,716,911 | 1/1988 | Poulose et al. . | |

FOREIGN PATENT DOCUMENTS

| | | |
|---|---|---|
| 117189 | 8/1984 | European Pat. Off. . |
| 2069814 | 9/1981 | United Kingdom . |

*Primary Examiner*—V Millin

*Assistant Examiner*—Jennifer L. Doyle

[57] ABSTRACT

Tobacco material having a reduced protein content is provided by first extracting water soluble components from tobacco. The extracted residue then is subjected to enzyme treatment using an enzyme which can decompose water insoluble protein molecules to smaller sized water soluble molecular components. The enzyme treated extracted tobacco material then is isolated. The extracted tobacco components then can be reapplied to the protein reduced tobacco material. The tobacco material so processed is use as smokable material for cigarette manufacture.

18 Claims, 1 Drawing Sheet

TOBACCO PROCESSING

BACKGROUND OF THE INVENTION

The present invention relates to a process for the preparation of tobacco having a reduced protein content.

Cigarettes are popular smoking articles which have a substantially cylindrical rod shaped structure and include a charge of tobacco (i.e., in cut filler form) surrounded by a paper wrapper thereby forming a tobacco rod. Popular cigarettes include blends of tobacco materials. Some cigarettes have cylindrical filters aligned in an end-to-end relationship with the tobacco rod. Typically, filters are manufactured from fibrous materials such as cellulose acetate and are attached to the tobacco rod using a circumscribing tipping material.

Recently, there has been interest in improving the smoking quality of tobacco. For example, U.K. Patent Application No. 2,069,814 as well as U.S. Pat. Nos. 4,407,307 and 4,537,204 to Gaisch et al, and 4,716,911 to Poulose et al propose processes for reducing the protein content of tobaccos. The proposed processes involve subjecting tobacco to enzymatic treatment in order to reduce the protein content of the tobacco.

It would be desirable to provide a process for efficiently and effectively providing tobacco having a reduced protein content.

SUMMARY OF THE INVENTION

The present invention relates to a process for reducing the protein content of tobacco. The process involves extracting components from tobacco material with a solvent having an aqueous character. The resulting extracted tobacco components then are separated from the extracted tobacco material. The extracted tobacco material then is subjected to aqueous enzyme treatment in order to decompose effective amounts of the essentially water insoluble nitrogen-containing (e.g., protein) components of that tobacco material into water soluble and/or dispersible fragments. The tobacco material so treated then is separated from the aqueous liquid, enzyme treatment components, and water soluble and water dispersible protein fragments; thereby isolating the protein-reduced tobacco material.

The process of this invention provides the skilled artisan with an efficient and effective method for obtaining processed tobacco having a reduced protein content. For example, the treated tobacco material having a relatively low protein content can be recombined with the original aqueously extracted tobacco components to provide a reconstituted tobacco material having a low protein content. Tobacco materials so processed are useful as smokable materials for the manufacture of cigarettes and other smoking articles.

DETAILED DESCRIPTION OF THE PREFERRED EMBODIMENTS

Figure 1:
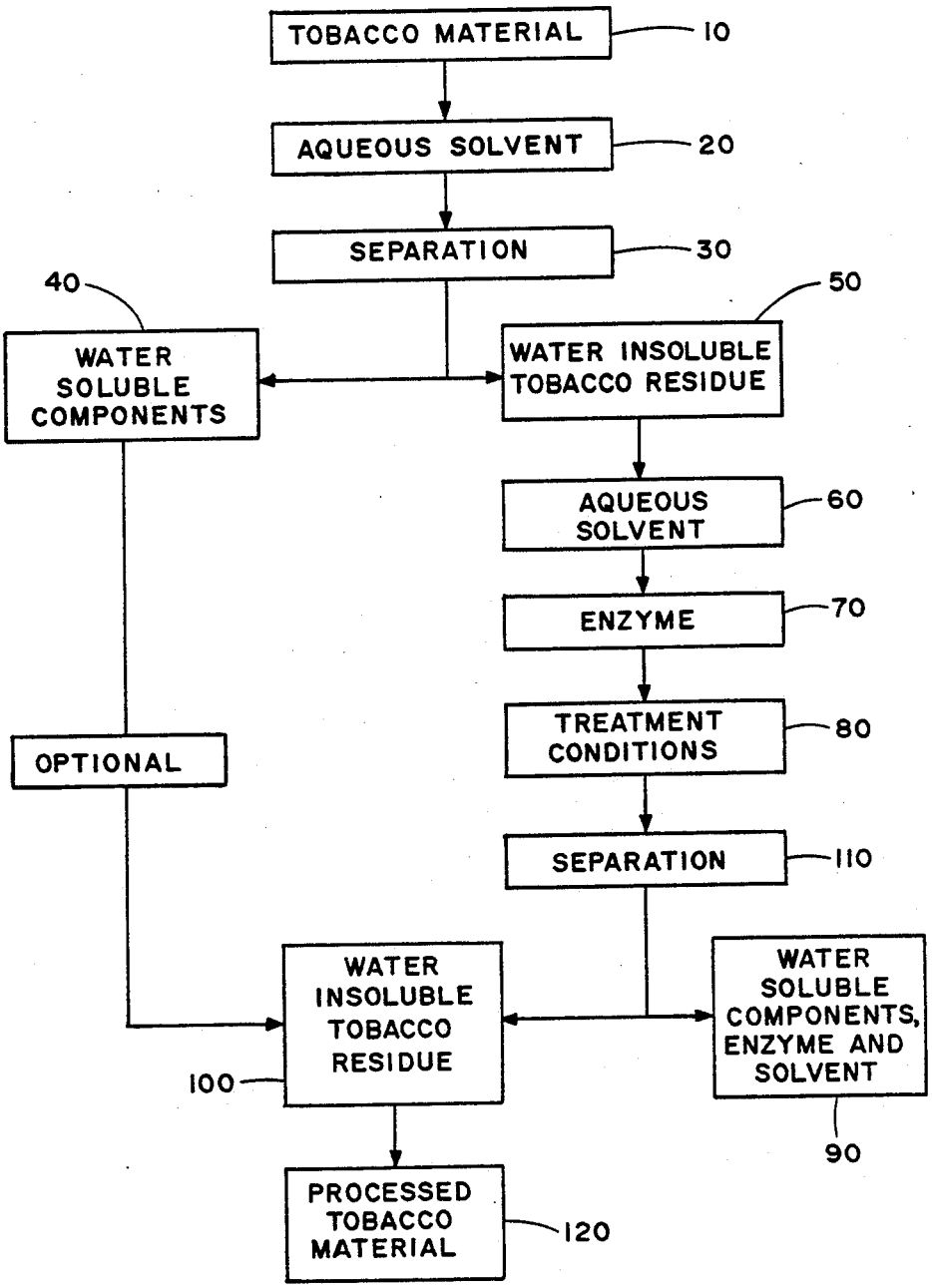
FIG. 1 is a schematic diagram of the process steps representative of one embodiment of this invention.

Referring to FIG. 1, tobacco material 10 is contacted with an aqueous solvent 20. As a result, water soluble components are extracted from the tobacco by the solvent. The mixture is subjected to separation conditions 30 so as to provide an aqueous solution 40 of water soluble tobacco components and a water insoluble residue 50 of extracted tobacco material. The solution of extracted tobacco components may contain enzyme inhibitors which are naturally present in the tobacco. The extracted tobacco material 50 is contacted with a second aqueous solvent 60, and the mixture is further contacted with enzyme 70. The extracted tobacco material 50, aqueous solvent 60 and enzyme 70 are maintained in contact under conditions 80 such that the enzyme can decompose protein components (e.g., by hydrolysis) of the tobacco to smaller sized molecular components. The aqueous portion containing spent enzyme and water soluble and water dispersible decomposed protein components 90, and the insoluble tobacco residue 100, are subjected to a separation step 110 in order to isolate the remaining insoluble tobacco residue 100. The remaining residue 100 has a reduced protein content relative to extracted tobacco material 50.

If desired, the aqueous solution 40, which contains water soluble tobacco components and any enzyme inhibitors which may have been extracted from the tobacco, can be reapplied to the tobacco residue 100. The resulting processed tobacco material 120 has a reduced protein content relative to that of the starting tobacco material 10.

The tobacco material can vary. Examples of suitable tobaccos include flue-cured, Burley, Maryland, and Oriental tobaccos, as well as the rare or specialty tobaccos. The tobacco material can be in the form of leaf, laminae and/or stem, or can be in a processed form. For example, the tobacco material can be subjected to volume expansion conditions. Tobacco waste materials and processing by-products such as fines, dust, scrap, stems and stalks can be employed. The aforementioned materials can be processed separately, or as blends thereof.

The tobacco material can have a variety of sizes for extraction. For example, the tobacco can be in strip form or cut filler form. Tobacco materials in strip or cut filler form are desirable in that the spent materials which remain after the extraction step can be dried and further employed in the manufacture of smokable materials. Alternatively, the tobacco can be ground to a powder of fine size. Small particle size tobacco materials are desirable in order to provide for increased extraction efficiency as well as decrease the time period over which extraction may occur.

The tobacco material is contacted with a first solvent having an aqueous character. Such a solvent consists primarily of water, and can be essentially pure water in certain circumstances. However, the solvent can include water having substances such as pH buffers or the like dissolved therein. The solvent also can be a co-solvent mixture of water and minor amounts of one or more solvents which are miscible therewith. An example of such a co-solvent mixture is a solvent consisting of 95 parts water and 5 parts ethanol. An example of another co-solvent mixture is a solvent consisting of 90 parts water and 10 parts ethanol. An example of yet another co-solvent mixture is a solvent consisting of 90 parts water and 10 parts dimethyl sulfoxide.

The amount of tobacco material which is contacted with the first solvent can vary. Typically, the weight of solvent relative to the tobacco material is greater than 6:1, oftentimes greater than 8:1 and in certain instances greater than 12:1. The amount of solvent relative to tobacco material depends upon factors such as the type of solvent, the temperature at which the extraction is performed, the type or form of tobacco which is extracted, the manner in which contact of the tobacco material and solvent is conducted, and other such factors. The manner of contacting the tobacco material and first solvent is not particularly critical.

The conditions under which the first extraction is performed can vary. Typical temperatures range from about 5° C. to about 75° C., with about 15° C. to about 30° C. being preferred, and ambient temperature being especially preferred. The solvent/tobacco material mixture can be agitated (e.g., stirred, shaken or otherwise mixed) in order to increase the rate at which extraction occurs. Typically, adequate extraction of components occurs in less than about 60 minutes, oftentimes less than about 30 minutes. The tobacco material can be subjected to a continuous aqueous extraction, if desired.

A wide variety of materials or components can be extracted from the tobacco materials. The particular materials and the amounts of the particular materials which are extracted often depend upon the type of tobacco which is processed, the properties of the particular solvent, and the extraction conditions (e.g., which include the temperature at which the extraction occurs as well as the time period over which an extraction is carried out). For example, a solvent consisting essentially of pure water will most often extract primarily the water soluble components of the tobacco material, while a co-solvent mixture of water and a minor amount of an alcohol can extract the water soluble components of the tobacco material as well as certain amounts of components having other solubility characteristics.

The solvent and extracted components are separated from the insoluble residue. The manner of separation can vary; however, it is convenient to employ conventional separation means such as filtration, centrifugation, or the like. Preferably, the insoluble residue is separated from as much of the extracted tobacco components as is possible. For example, the residue can be pressed or squeezed to remove solvent and extracted components therefrom. The residue then can be (i) used as such, or (ii) drum dried, subjected to a freeze drying operation, or subjected to any other suitable type of drying step.

The insoluble residue is contacted with a second liquid having an aqueous character. Aqueous solvents advantageously are employed due to the fact that enzymatic activity is effective using at least some water as liquid medium. Typically, the weight of the liquid relative to the tobacco residue is greater than about 10:1, and is often greater than about 12:1. The amount of liquid medium relative to tobacco material depends upon factors such as the type, form or size of the tobacco material, the particular enzyme employed, the particular enzyme activity, and the like.

The conditions under which the enzyme treatment is performed depends upon factors such as the pH of the aqueous medium, the temperature of the liquid medium and tobacco residue, the concentration of the enzyme, the amount of liquid medium relative to the tobacco residue, and the like. Typically, the pH of the aqueous medium is between about 7 and about 8.5, for most applications. Generally, the temperature of the liquid medium and tobacco residue is between about 25° C. and 60° C. during enzyme treatment.

The enzyme employed is an enzyme which can digest or decompose protein to smaller sized molecular components. Typically, the enzyme is a solubilizing protease. Examples of proteases which can be used include dispase, protease K, pronase, thermolysin, trypsin, chymotrypsin, bromelain, subtilisin, proteinase, papain, rhozyme proteases, and the like. If desired, combinations of proteases can be employed for effective enzyme treatment. Additionally, a series of enzyme treatments can be performed using different enzymes under different types of treatment conditions.

The amount of enzyme employed relative to the tobacco material can vary. Generally, for cost effective use of the enzyme, it is desirable to employ sufficient amount of enzyme under conditions such that the tobacco protein will be reduced by about 50 percent before the enzyme loses 90 percent of its original activity. As such, the amount of enzyme employed can be determined by experimentation. The time period over which enzyme treatment occurs typically is between about 1 hour and about 8 hours.

If desired, the tobacco material (e.g., tobacco residue) can be subjected to additional enzyme treatment prior to or simultaneous to the protease enzyme treatment. For example, the tobacco residue can be subjected to enzyme treatment using a depolymerase enzyme such as cellulase, pectinase, lipase, ligninase, cutinase, amylase, or the like. Treatment of the tobacco residue using depolymerase enzymes can provide for an efficient treatment using the protease enzyme. Conditions for treating the tobacco residue with the depolymerase enzyme will be apparent to the skilled artisan.

The liquid medium is separated from the treated insoluble tobacco residue using centrifugation techniques, or the like. As such, the treated insoluble residue is isolated; and the liquid medium containing the decomposed protein fragments can be collected and discarded. In particular, the insoluble residue is separated from a majority or essentially all of the liquid medium and water soluble and water dispersible decomposed protein fragments so as to isolate the extracted tobacco material (i.e., the insoluble tobacco residue). The liquid medium and insoluble residue can be heated or otherwise processed to terminate the activity of the enzyme prior to or during the separation steps. If desired, the tobacco residue can be washed with water to further remove therefrom as much of the decomposed protein fragments as possible.

The enzymatic treatment of the tobacco material results in the decomposition of protein fragments. Many of the resulting protein fragments are solubilized and/or dispersed in the liquid medium, and hence are readily separated from the tobacco residue. As such, the protein is provided in such a form that a significant amount thereof conveniently is removed from the tobacco material.

The insoluble residue can be dried to a low moisture content using freeze drying techniques, or the like. Alternatively, the treated residue can be used directly to provide a reconstituted tobacco material using conventional techniques such as cast sheet processes, paper making processes, extrusion processes, dry reconstitution processes, or the like.

If desired, at least a portion of the original aqueous solution of extracted tobacco components can be reapplied to the treated tobacco residue. The aqueous solution of extracted components can be applied as such; concentrated before application; spray dried or freeze dried prior to application; treated or otherwise processed to remove selected components such as potassium nitrate prior to application; or the like. Representative freeze drying and spray drying processes are set forth in U.S. Pat. Nos. 3,316,919 to Green and 3,398,754 to Tughan. In most instances, the extract conveniently is reapplied to the treated tobacco residue without subjecting the extract to any enzymatic treatment. It often is convenient to dry the treated tobacco residue prior to the time that the aqueous solution of extracted components is applied thereto. For example, the treated tobacco residue in the form of strip or cut filler, or which is reformed using a reconstitution process, can be dried to a moisture level of less than about 15 weight percent; and then the aqueous solution of extracted tobacco components can be applied thereto. Manners and methods for drying the treated tobacco residue will be apparent to the skilled artisan.

The following examples are provided in order to further illustrate various embodiments of the invention but should not be construed as limiting the scope thereof. Unless otherwise noted, all parts and percentages are by weight.

EXAMPLE 1

Flue cured tobacco in cut filler form is extracted with a water solvent at a temperature less than 75° C. The water is absent of added enzymatic material. The water extracted tobacco material is pressed to remove water and water extracted components therefrom. The extracted tobacco material then is drum dried to a moisture level of about 11 percent. About 45 percent of the tobacco weight is removed during the extraction step.

Into 1 l of water buffered to a pH of 8 using potassium monobasic phosphate and sodium hydroxide is charged 50 g of the previously described extracted and dried tobacco material. The mixture of buffered water and extracted tobacco material is maintained at 50° C. To the mixture is charged 0.13 g of enzyme EC3.4.21.14 having a specific activity of 2.4 Anson Units/g. One Anson Unit (AU) is the amount of enzyme which, under standard conditions, digests hemoglobin at an initial rate liberating per minute an amount of trichloroacetic acid soluble product which gives the same color with phenol reagent as one milliequivalent of tyrosine. The mixture is stirred using a mechanical stirrer and held at 50° C., while the pH is monitored and maintained at a value of 8 using the previously described buffer.

At 2, 4, and 6 hour intervals, a sample of wet tobacco residue is strained so as to provide a wet sample weighing about 10 g. Each sample is washed three times with 750 ml of water. The residue is centrifuged, and then freeze-dried to a solid form. The samples are analyzed for total nitrogen and water soluble nitrogen. Protein nitrogen is determined by subtracting analyzed water soluble nitrogen from analyzed total nitrogen. Data are presented in Table I.

TABLE I

| Sample | Protein[1] Nitrogen (%) | Total[1] Nitrogen (%) | Protein[1] Reduction (%) |
|---|---|---|---|
| Control* | 2.42 | 2.91 | — |
| 2-Hour | 1.95 | 2.20 | 19 |
| 4-Hour | 1.66 | 1.94 | 31 |
| 6-Hour | 1.60 | 1.87 | 34 |

*Control sample is not an example of the invention, and is a sample of the water extracted tobacco analyzed prior to enzymatic treatment.
[1]Percent values are based on dry weight of tobacco residue.

The data in Table I indicate that the process steps provide tobacco material having reduced protein content.

EXAMPLE 2

The procedure described in Example 1 is repeated, except that the tobacco/aqueous liquid mixture is charged with 0.33 g of enzyme EC3.4.21.14 having a specific activity of 2.4 AU/g.

At 2, 4, 6 and 8 hour intervals, a sample of wet tobacco residue is strained so as to provide a wet sample weighing about 10 g. Each sample is washed three times with 750 ml of water. The residue is centrifuged, and then freeze-dried to a solid form. The samples are analyzed for total nitrogen and water soluble nitrogen. Protein nitrogen is determined by subtracting analyzed water soluble nitrogen from analyzed total nitrogen. Data are presented in Table II.

TABLE II

| Sample | Protein[1] Nitrogen (%) | Total[1] Nitrogen (%) | Protein[1] Reduction (%) |
|---|---|---|---|
| Control* | 2.61 | 3.05 | — |
| 2-Hour | 1.76 | 2.05 | 33 |
| 4-Hour | 1.56 | 1.85 | 40 |
| 6-Hour | 1.44 | 1.66 | 45 |
| 8-Hour | 1.41 | 1.63 | 46 |

*Control sample is not an example of the invention, and is a sample of the water extracted tobacco analyzed prior to enzymatic treatment.
[1]See footnote 1 of Table I.

The data in Table II indicate that the process steps provide tobacco material having reduced protein content.

EXAMPLE 3

The procedure described in Example 1 is repeated, except that the tobacco/aqueous liquid mixture is charged with 0.65 g of enzyme EC3.4.21.14 having a specific activity of 2.4 AU/g.

At 2, 4, and 6 hour intervals, a sample of wet tobacco residue is strained so as to provide a wet sample weighing about 10 g. Each sample is washed three times with 750 ml of water. The residue is centrifuged, and then freeze-dried to a solid form. The samples are analyzed for total nitrogen and water soluble nitrogen. Protein nitrogen is determined by subtracting analyzed water soluble nitrogen from analyzed total nitrogen. Data are presented in Table III.

TABLE III

| Sample | Protein[1] Nitrogen (%) | Total[1] Nitrogen (%) | Protein[1] Reduction (%) |
|---|---|---|---|
| Control* | 2.42 | 2.67 | — |
| 2-Hour | 1.16 | 1.36 | 52 |
| 4-Hour | 1.00 | 1.17 | 59 |
| 6-Hour | 0.99 | 1.06 | 59 |

*Control sample is not an example of the invention, and is a sample of the water extracted tobacco analyzed prior to enzymatic treatment.
[1]See footnote 1 of Table I.

The data in Table III indicate that the process steps provide tobacco material having a protein content reduced by greater than 50 percent.

EXAMPLE 4

The procedure described in Example 1 is repeated, except that the tobacco is a Burley blend in cut filler form, and tobacco/aqueous liquid mixture is charged with 0.65 g of enzyme EC3.4.21.14 having a specific activity of 2.4 AU/g.

At 2, 4, and 6 hour intervals, a sample of wet tobacco residue is strained so as to provide a wet sample weighing about 10 g. Each sample is washed three times with 750 ml of water. The residue is centrifuged, and then freeze-dried to a solid form. The samples are analyzed for total nitrogen and water soluble nitrogen. Protein nitrogen is determined by subtracting analyzed water soluble nitrogen from analyzed total nitrogen. Data are presented in Table IV.

TABLE IV

| Sample | Protein[1] Nitrogen (%) | Total[1] Nitrogen (%) | Protein[1] Reduction (%) |
|---|---|---|---|
| Control* | 3.14 | 3.29 | — |
| 2-Hour | 1.61 | 1.85 | 49 |
| 4-Hour | 1.35 | 1.58 | 57 |
| 6-Hour | 1.27 | 1.47 | 60 |

*Control sample is not an example of the invention, and is a sample of the water extracted tobacco analyzed prior to enzymatic treatment.
[1]See footnote 1 of Table I.

The data in Table IV indicate that the process steps provide Burley tobacco material having a protein content reduced by greater than 50 percent.

EXAMPLE 5

Flue cured tobacco in cut filler form is extracted with water at a temperature of 70° C. and agitated for 30 minutes. The water is absent of added enzymatic material. In particular, 25 pounds of tobacco is mixed with 75 gallons of water. The mixture then is centrifuged to yield a wet residue weighing about 67 pounds.

Into 35 gallons of water buffered to a pH of 8 and maintained at 50° C., is charged 140 g of enzyme EC3.4.21.14 having a specific activity of 2.4 AU/g followed by the wet tobacco residue. The resulting mixture is agitated at 50° C. for about 5 hours, while the pH is monitored and maintained at about 8.

The mixture then is mixed with 165 gallons of water and centrifuged. The wet residue, weighing 183 pounds, is combined with 19 gallons of water, and is heated with stirring to about 80° C. for about 30 minutes. The residue is passed three times through a Reitz Laboratory Disintegrator.

The protein nitrogen content of the resulting enzyme treated tobacco residue is 0.76 percent, based on the dry weight of the tobacco. The protein nitrogen content of the water extracted tobacco material prior to enzyme treatment is 2.60 percent, based on the dry weight of the tobacco. Hence, greater than about 70 percent of the protein content of the tobacco material is removed therefrom.

The tobacco residue then is cast onto a stainless steel belt having a temperature of about 300° C., and into sheets having a thickness of about 1 mm. The resulting reconstituted tobacco sheets are dried to a moisture content of about 12 percent, cut into cut filler form, and can be used in the manufacture of cigarettes.

What is claimed is:

1. A process for reducing the protein content of tobacco material, the process comprising:
   (i) extracting components from tobacco material with a solvent having an aqueous character; and then
   (ii) separating extracted tobacco components from extracted tobacco material; and then
   (iii) subjecting the extracted tobacco material to aqueous enzyme treatment in the presence of a liquid having an aqueous character and in the presence of a protease to decompose essentially water insoluble protein components of the tobacco material to water soluble and/or water dispersible fragments; and then
   (iv) separating the extracted tobacco material of step (iii) from the liquid, the protease and the water soluble and/or water dispersible fragments.

2. The process of claim 1 further comprising contacting the extracted tobacco material of step (iv) with extracted tobacco components of step (ii).

3. The process of claim 2 whereby the extracted tobacco components of step (ii) are subjected to a spray drying operation, and the resulting spray dried material is contacted with the extracted tobacco material of step (iv).

4. The process of claim 1 further comprising subjecting the extracted tobacco material to aqueous enzyme treatment with a depolymerase enzyme prior to or simultaneous to the enzyme treatment of step (iii).

5. The process of claim 1 further comprising subjecting the extracted tobacco material of step (iv) to a drying process.

6. The process of claim 5 further comprising contacting the extracted tobacco material of step (iv) with extracted tobacco components of step (ii).

7. The process of claim 6 whereby the extracted tobacco components of step (ii) are subjected to a spray drying operation, and the resulting spray dried material is contacted with the extracted tobacco material of step (iv).

8. The process of claim 1 whereby the extracted tobacco of step (ii) is subjected to enzyme treatment sufficient to reduce the protein content thereof by more than 50 weight percent.

9. The process of claim 1 whereby the extracted tobacco of step (ii) is subjected to enzyme treatment sufficient to reduce the protein content thereof by more than 70 weight percent.

10. The process of claim 1 whereby the tobacco material is Burley tobacco.

11. The process of claim 1 whereby the extracted tobacco material is subjected to enzyme treatment in the presence of an aqueous medium having a pH between about 7 and about 8.5.

12. The process of claim 1 whereby the solvent is water.

13. The process of claim 1 whereby the liquid is water.

14. The process of claim 1 whereby the liquid medium and tobacco material are processed prior to step (iv) to terminate the activity of the enzyme.

15. The process of claim 1 whereby the extracted tobacco material is separated from the solvent and the extracted tobacco components using a centrifugation technique.

16. The process of claim 1 whereby the extracted tobacco material is separated from a majority of the liquid, the protease and the water soluble and/or water dispersible fragments.

17. The process of claim 1 whereby the tobacco material of step (iv) is washed with water to remove decomposed water soluble and/or water dispersible protein fragments.

18. The process of claim 1 whereby the extracted tobacco material is subjected to a drying step prior to step (iii).

* * * * *